United States Patent [19]

Radcliff

[11] Patent Number: 5,004,279

[45] Date of Patent: Apr. 2, 1991

[54] DOOR LATCH HOLDER

[76] Inventor: Ruth Radcliff, P.O. Box 2881, Warner Robins, Ga. 31099

[21] Appl. No.: 382,223

[22] Filed: Jul. 20, 1989

[51] Int. Cl.[5] ..... E05C 19/18

[52] U.S. Cl. ..... 292/288; 16/82

[58] Field of Search ..... 16/82, 86 A, 116 A; 292/288, 258, 246, DIG. 56, DIG. 73, DIG. 2, DIG. 18, DIG. 19, 318-320

[56] References Cited

U.S. PATENT DOCUMENTS

| | | | |
|---|---|---|---|
| 827,624 | 7/1906 | Foster | 292/288 |
| 848,644 | 4/1907 | Flegel | 292/288 |
| 1,520,199 | 12/1924 | Morgan | 293/124 X |
| 2,261,064 | 10/1941 | Katz | 16/116 A |
| 2,726,892 | 12/1955 | Zynda et al. | 292/288 |
| 3,863,477 | 2/1975 | Klein | 70/456 R |
| 3,980,202 | 9/1976 | Monyak et al. | 292/288 X |
| 4,037,442 | 7/1977 | Staude et al. | 70/456 R |
| 4,248,071 | 2/1981 | Kussoy | 70/456 R |
| 4,289,003 | 9/1981 | Yang | 70/456 B |
| 4,543,803 | 10/1985 | Keyasko | 63/3 X |
| 4,811,454 | 3/1989 | Crook et al. | 292/246 X |
| 4,869,305 | 9/1989 | Jones | 292/DIG. 2 X |

FOREIGN PATENT DOCUMENTS

| | | | |
|---|---|---|---|
| 172363 | 10/1916 | Canada | 16/82 |

*Primary Examiner*—Lloyd A. Gall

*Attorney, Agent, or Firm*—H. Jay Spiegel

[57] ABSTRACT

The present invention relates to an improved door latch holder designed to be mounted on the two knobs of a door and having a central portion designed to overlie a door latch. In the position described above, the door latch will be retracted into the door so that the door may be opened and closed without twisting one of the knobs thereof.

3 Claims, 1 Drawing Sheet

DOOR LATCH HOLDER

BACKGROUND OF THE INVENTION

The present invention relates to an improved door latch holder. In the prior art, devices designed to be affixed to door knobs for one purpose or another are known, as taught by U.S. Pat. No. 848,644 to Flegel and U.S. Pat. No. 1,520,199 to Morgan. Furthermore, devices including a widened central portion with openings at its ends are known, as taught by U.S. Pat. No. 1,619,067 to Gammeter. Finally, devices designed to be used to keep a door slightly ajar are known, as taught by U.S. Pat. No. 2,249,294 to Kohler and U.S. Pat. No. 2,565,906 to Berthene.

However, Applicant is unaware of any prior art teaching a device designed to hold a door latch in a retracted position by overlying the door latch with a device attached to the two door knobs of the associated door.

SUMMARY OF THE INVENTION

The present invention relates to an improved door latch holder. The present invention includes the following interrelated aspects and features:

(a) In a first aspect, the inventive device has a body preferably made of a cloth material and of oval-shaped construction. The body includes an internal chamber accessible through a slotted portion on an edge thereof.

(b) In the preferred embodiment of the present invention, the above-described internal chamber may be filled with stuffing material and the amount of stuffing material within the chamber may be adjusted as desired for particular applications.

(c) On each end of the body, a loop-like attachment device is provided. Each loop-like attachment device is sized and configured to be able to be placed over one door knob of an associated door so that with each loop-like attachment device placed over one door knob, the body overlies the associated door latch causing the door latch to be retracted. Furthermore, the body isolates the door latch from the door frame so that the latch may not enter a recess in the door frame to hold the door closed. Thus, with the inventive improved door latch holder placed on a door, the door may not be latched shut.

As such, it is a first object of the present invention to provide an improved door latch holder.

It is a further object of the present invention to provide such a device which may be used to restrain the latch mechanism of a door so that the door may not be latched in a closed position thereof.

It is a still further object of the present invention to provide such a device which may be easily installed on a door and removed therefrom.

These and other objects, aspects and features of the present invention will be better understood from the following detailed description of the preferred embodiments when read in conjunction with the appended drawing figures.

SPECIFIC DESCRIPTION OF THE PREFERRED EMBODIMENT

Figure 1:
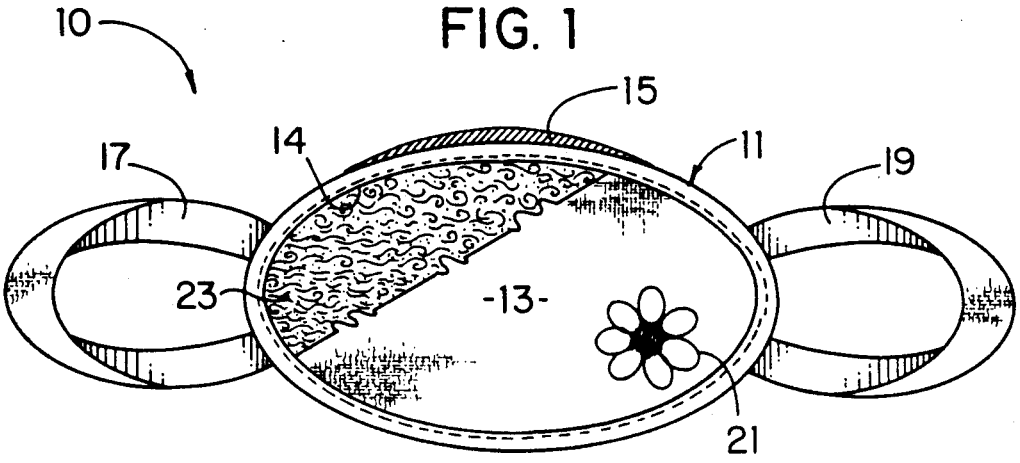
FIG. 1 shows a front view of the present invention with certain portions thereof broken away to show detail.

With reference, first, to FIG. 1, the inventive device is generally designated by the reference numeral 10 and is seen to include a holder body 11 preferably made of cloth and of an oval-shaped configuration. The body 11 has a front surface 13 having a great face may have a design or other logo 21 thereon. At each lateral side of the body 11, a loop-like strap attachment means comprising a loop provided. These loops are designated by the respective numerals 17 and 19 and are preferably substantially identical to one another.

Figure 2:
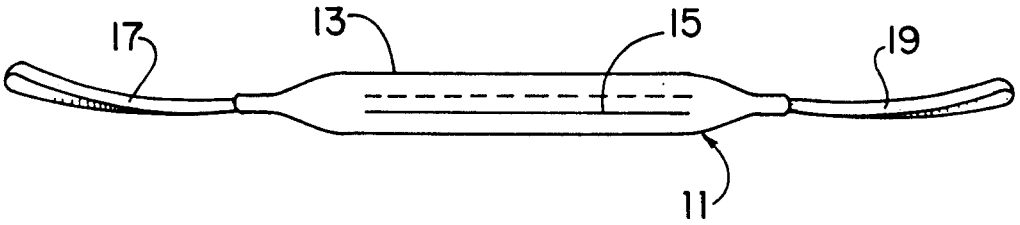
FIG. 2 shows a top view of the invention.

A broken-away portion of the front 13 of the body 11 shows the internal chamber 14 in which stuffing 23 has been placed. With reference to FIGS. 1 and 2, a slot 15 is provided in the body 11 with the dotted line in FIG. 2 depicting an overlapping portion of the cloth which provides closure for the chamber 14. The slot 15 provides access to the chamber 14 so that stuffing 23 may be added or removed as desired or required for the particular application.

Figure 3:
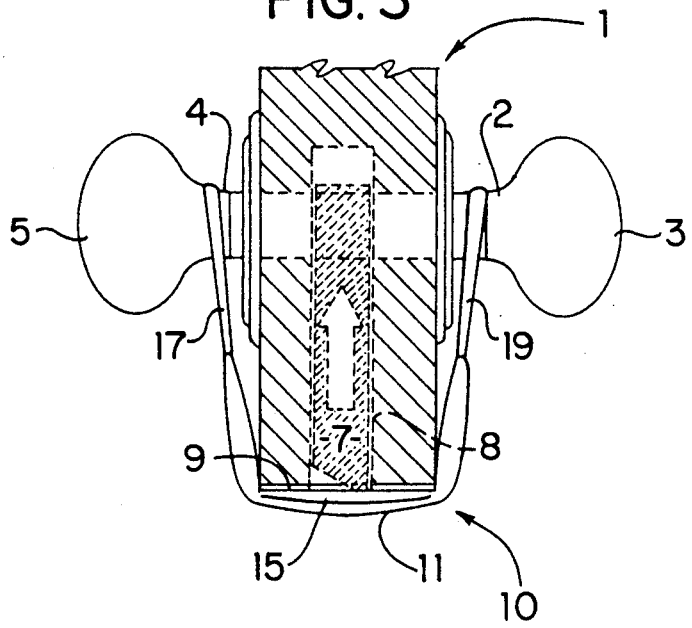
FIG. 3 shows a top view of a door having the inventive device mounted thereon.

The loop-like attachment means 17, 19 are sized and configured to be able to go over door knobs of a door and to rest on the neck portions of the door knobs. In this regard, reference is made to FIG. 3, wherein a door 1 is seen to include knobs 3 and 5, respective neck portions 2 and 4, a side edge 9 for the door, a retractable latch 7 riding in a latch chamber 8. The inventive device 10 is seen to be removably mounted on the door 1 with the loop-like attachment means 17, 19 respectively hanging over the necks 4, 2 of the respective door knobs 5, 3. In the position shown, the body 11 overlies the latch 7, causing it to be in the retracted position shown. In the position shown in FIG. 3, the door may be closed against the associated door frame (not shown) with the latch 7 being maintained retracted within the chamber 8 so that the door 1 may not be latched in the closed position thereof. In this way, the door may be opened and closed without twisting one of the knobs 5 or 3. Furthermore, the thickness of the body 11 allows frictional retention within the door frame, with this frictional retention being adjustable by adjusting the amount of stuffing 23 which has been placed within the chamber 14, which adjusts the thickness of the body 11 in a direction substantially perpendicular to the faces thereof.

As such, an invention has been described in terms of a preferred embodiment thereof which fulfills each and every one of the objects of the invention as set forth hereinabove and provides a new and improved door latch holder allowing the latch of a door to be maintained in a retracted orientation.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. In a door having a door body, an edge with a recess guiding a retractable latch, said latch being operated by either one of two door knobs on said door body, the improvement comprising a door latch holder having:

(a) a holder body having a front face and a rear face and a prescribed thickness substantially perpendicular to said faces therebetween, said holder body having two lateral sides at side terminations of said faces, said rear face adapted to overlie said edge and said latch;

(b) attachment means comprising a loop attached on each said side of said body, each said loop mountable over a respective said door knob;

(c) said holder with said loops mounted over said knobs restraining said latch in a retracted position.

2. The door latch holder of claim 1, wherein said body has an internal chamber filled with stuffing.

3. The door latch holder of claim 2, wherein said body has an access opening allowing stuffing material to be added to or taken from said chamber.

* * * * *